US005243827A

United States Patent [19]

Hagita et al.

[11] Patent Number: 5,243,827

[45] Date of Patent: Sep. 14, 1993

[54] OVERHEAT PREVENTING METHOD FOR PRESCRIBED DISPLACEMENT TYPE COMPRESSOR AND APPARATUS FOR THE SAME

[75] Inventors: Naomi Hagita; Takao Mizuno, both of Shimizu, Japan

[73] Assignees: Hitachi, Ltd., Tokyo; Hitachi Shimizu Engineering Co., Ltd., Shizuoka, both of Japan

[21] Appl. No.: 870,770

[22] Filed: Apr. 21, 1992

Related U.S. Application Data

[63] Continuation of Ser. No. 556,657, Jul. 24, 1990, abandoned.

[30] Foreign Application Priority Data

Jul. 31, 1989 [JP] Japan ..... 1-196595

[51] Int. Cl.[5] ..... F25B 41/00

[52] U.S. Cl. ..... 62/113; 62/197; 62/196.3; 62/505

[58] Field of Search ..... 62/505, 197, 196.1, 62/196.2, 196.3, 86, 113, 119; 418/84, 87, 97, 100

[56] References Cited

U.S. PATENT DOCUMENTS 4,049,410 9/1977 Miller ..... 62/505 X
4,326,868 4/1982 Ozu et al. ..... 62/196.3 X
4,861,246 8/1989 Zimmern ..... 418/84

FOREIGN PATENT DOCUMENTS 0065894 4/1982 Japan .
0166778 8/1985 Japan .

*Primary Examiner*—John M. Sollecito
*Attorney, Agent, or Firm*—Antonelli, Terry, Stout & Kraus

[57] ABSTRACT

An overheating prevention method for a fixed displacement type compressor having an overheating prevention device for introducing a part of high pressure liquefied coolant, liquefied in a compressor of a refrigeration cycle, into a compression chamber maintained under a compression stroke of the compressor through a connecting pipe, and for controlling a flow rate of the liquefied coolant flowing through the communication pipe to thereby cool the compressor. The connecting pipe is communicated with the compressor so that an average pressure within the compressor is reduced relative to a condensed pressure under a minimum operational pressure ratio condition at which the introduction of the liquefied coolant is required for cooling the compressor, within an operational pressure range in which the condensed pressure and evaporation pressure are respectively variable. The high pressure liquefied coolant may be introduced into the compression chamber, kept under the compression stroke, from a plurality of positions.

13 Claims, 4 Drawing Sheets

OVERHEAT PREVENTING METHOD FOR PRESCRIBED DISPLACEMENT TYPE COMPRESSOR AND APPARATUS FOR THE SAME

This application is a continuation of application Ser. No. 556,657, filed on Jul. 24, 1990 abandon.

BACKGROUND OF THE INVENTION

1. Field of the Invention

The present invention relates to a refrigerating apparatus provided with a fixed displacement type compressor for refrigeration, and, more particularly, to a method and apparatus for preventing an overheating of a compressor over a wide pressure range by introducing a part of a high pressure liquefied coolant, condensed in a condensor of a refrigeration cycle, into a compression chamber kept under a compression stroke of the compressor through a communicating pipe.

2. Description of the Prior Art

A conventional method for preventing an overheating of a compressor by introducing a high pressure liquefied coolant, condensed in a condensor, into a compression chamber of the compressor has been applied to many types of compressors, and a high pressure liquefied coolant has been introduced into the compression chamber of the compressor in order to prevent an overheating of the compressor. For example, Japanese Patent Unexamined Publication 60-166778, proposes a displacement compressor in which overheating is prevented by introducing a high pressure liquefied coolant into a compression chamber of the compressor.

In a fixed displacement type compressor, an average pressure at a position where a communicating pipe is in fluid communication with a compression chamber maintained under the compression stroke of the compressor is determined substantially in dependence upon the operational pressure of a lower pressure side thereof and the position at which the communicating pipe is connected to the compression chamber. The introduction of the liquefied coolant is performed in accordance with a pressure differential between the operational high pressure liquefied coolant pressure and the average pressure at the communicating position of the communicating pipe derived from the compression chamber under the compression stroke within the compressor, only when the former pressure is higher than the latter pressure. Under such a specific operational condition, it would be impossible to introduce the coolant into the compression chamber because the former pressure is lower than the latter pressure and consequently the compressor would overheat. Also when the latter pressure is extremely low relative to the former pressure and the pressure differential therebetween is increased, the amount of the introduced liquefied coolant is increased. As a result, the consumption of electric power increases due to the increase of the gas compression power or the compressor would be excessively cooled down. There has been no consideration given to the communicating position of the communicating pipe for introducing the liquefied coolant or of the cooling condition and compression power of the compressor. In particular, in the case where the compressor is used over a wide operational pressure range, there is a problem that, depending upon the introduction position of the liquefied coolant, the cooling effect would be insufficient at the low operational pressure ratio, the cooling efect would be excessive at the high operational pressure ratio, and the consumption electric power due to the increased compression power would be increased. In a compressor which may be cooled over the wide operational pressure range by introducing the liquefied coolant through one position, there would be a problem that an undesired compression power would be increased in accordance with the introduction of the liquified coolant in particular on the lower evaporation temperature side (high operational pressure ratio).

With respect to an apparatus for preventing an overheating of the compressor by introducing a high pressure liquefied coolant into the compression chamber under the compression stroke within the compressor in a refrigeration cycle formed by the prescribed displacement type compressor, no consideration has been given to the communicating position of the connecting pipe for introducing the high pressure liquefied coolant during the compression stroke. In the fixed displacement type compressor, in the compression stroke, the compression is forcibly performed up to a prescribed pressure ratio determined in dependence upon the prescribed volume ratio and the coolant to be used, and thereafter, the condensation pressure is obtained by communicating the coolant to the discharge space. Accordingly, there are cases where the condensation pressure is lower than the average pressure of the communicating position of the connecting pipe during the compression stroke. In these cases, it is impossible to introduce the liquefied coolant therein. When the compressor is overheated or the evaporation pressure is low, the pressure differential between the communicating position pressure of the connecting pipe and the condensation pressure is increased so that the amount of the liquefied coolant introduced is increased and the compressor is excessively cooled. As a result, the consumption of electric power is increased because of the increase of the compression power, or the compression mechanism is damaged due to the liquid compression. At this time, even if the introduction of the liquefied coolant is controlled by the opening/closing operation of the solenoid valve, the opening/closing operations are frequently performed so that a stable operational condition of the compressor can not be attained.

On the other hand, when the system is used over a wide operational pressure range, in order to perform a suitable cooling effect at a high evaporation temperature, it is necessary to set the communicating position of the connecting pipe at a lower pressure side. Accordingly, this system suffers from problems such as excessive cooling and an increase of the compression power on the lower evaporation temperature side.

SUMMARY OF THE INVENTION

An object of the present invention is to overcome the foregoing problems and to effectively operate a compressor overheating preventing apparatus over an operational pressure range, to thereby cool the compressor and to prevent an increase of the compression power, caused by the introduction of the liquefied coolant, within a minimum possible level.

Another object of the invention is to determine the suitable communicating position of the connecting pipe in view of the excessive/deficient cooling effect of the compressor and suppression of the increase of the compression power, and further to selectively introduce the liquefied coolant into positions different in pressure in order to cover the wide operational pressure range, thereby attaining the highly effective operation.

A means for attaining these and other objects will be explained with reference to FIG. 2. In FIG. 2, an abscissa represents the evaporation pressure, and an ordinate represents the condensation pressure, with the evaporation pressure range being represented by $Ps_1$ to $Ps_2$, and the condensation pressure range being represented by $Pd_1$ to $Pd_2$. Straight lines O, P and Q represent iso-pressure ratio lines, with O representing a maximum pressure ratio, and with Q representing a minimum pressure ratio in the operation pressure range. The pressure range of portion R on a higher pressure side over the curve l within the operational pressure range is a range where the compressor should be cooled down, and the pressure range of portion S on a lower pressure side is a range where the compressor does not require cooling. A point m on the curve l is a minimum pressure ratio at which the cooling is needed, and at the point m, the pressure ratio is P. Accordingly, the communicating position of the connecting pipe is determined so as to enable to introduce the liquefied coolant in the region over the operational pressure ratio P. At the same time, the communicating position is determined so that the pressure ratio between the pressure at the communicating position of the connecting pipe and the evaporation pressure is not greater than P. Actually, since it is possible to introduce the liquefied coolant at the pressure differential between the condensation pressure and the communicating position of the connecting pipe, it is possible to perform the introduction of the liquefied coolant only when the compressor should be cooled, by communicating the connecting pipe to the compression chamber so that the pressure ratio between the evaporation pressure and the pressure at the communicating position of the connecting pipe is about 0.5 less than the pressure ratio P. Furthermore, the above-described connecting pipe is used as a first connecting pipe, a second connecting pipe is in communication with a position of the compression chamber during the compression stroke so, on the higher pressure side than that of the first connecting pipe, the pressure ratio relative to the evaporation pressure is less than zero. The first and second connecting pipes are controlled in accordance with the selective control of the inner temperature of a cooled box, the evaporation temperature and/or the evaporation pressure so that the second connecting pipe is used when the system is used under the operational condition of a relatively low evaporation temperature and the first connecting pipe is used in the operational condition of a relatively high evaporation temperature, thereby allowing the wider operation pressure range to be ensured. As a control method for opening/closing the connecting pipes, it is possible to use a timer or an discharge gas temperature in addition to the above-described method. At the same operational pressure ratio, comparing the average pressures in the compressor chamber communicated with the first and second connecting pipes, the communicating position pressure of the second connecting pipe is higher than the other, and hence the pressure differential for introducing the liquefied coolant is less so that the amount liquefied coolant introduced is less. Accordingly, since it is possible to suppress the amount of the liquefied coolant introduced by communicating the second communication pipe under the high pressure ratio operational condition, the temperature change of the compressor due to the introduction of the liquefied coolant is gentle and it is possible to reduce the frequency of the opening/closing operation of the control instrument. Since the liquefied coolant is introduced into the high pressure side, and the amount of the introduced liquefied coolant is decreased, it is possible to prevent the increase of the compression power. It is therefore possible to ensure the wide operation pressure range with a high operational efficiency.

The connecting pipe is communicated with the compression chamber so that the pressure ratio between the average pressure at the communication position of the connecting pipe with the compression chamber held under the compression stroke within the compressor and the evaporation pressure is equal to or less than P or about 0.5 less than P. It is therefore possible to introduce the liquefied coolant under the condition above the operational pressure ratio P including the operational pressure range R at which the liquefied coolant should be introduced, thereby allowing the compressor to be cooled. On the other hand, the liquefied coolant is not introduced under the condition below the operation pressure ratio P including the operational pressure range S at which the compressor should not be cooled. Thus, the unnecessary cooling is not effected.

On the other hand, when an increase of cooling of the compressor and a suppression of the compression power are desired over the wide operational pressure range, the first and second connecting pipes are selectively controlled in accordance with the operational pressure condition or the temperature condition, whereby it is possible to achieve the operation without excessively cooling/heating the compressor with a small amount of electric power consumption even over the wide operational pressure range.

DESCRIPTION OF THE PREFERRED EMBODIMENTS

Figure 1:
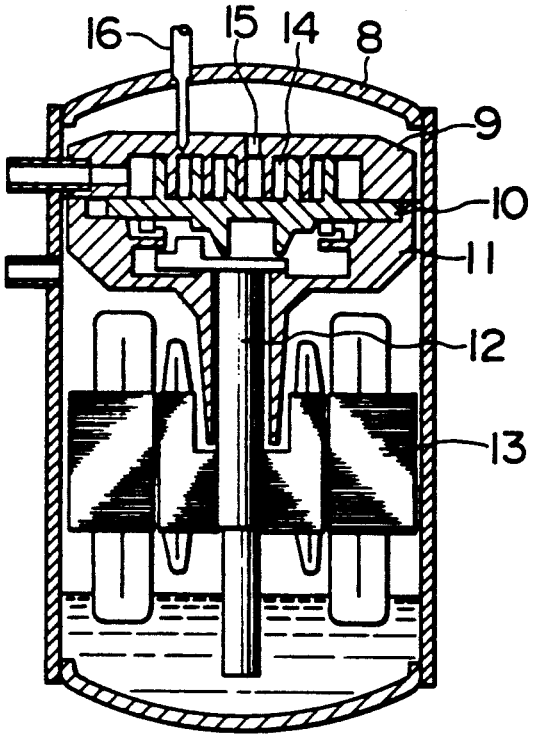
FIG. 1 is a vertical section of a displacement type compressor in accordance with one embodiment of the invention.
Figure 2:
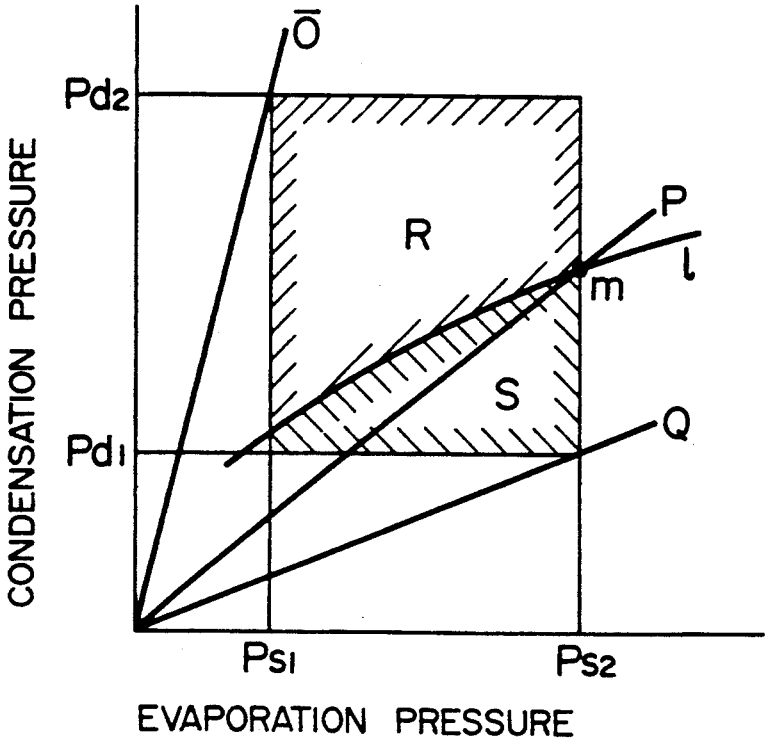
FIG. 2 is a graph showing a relationship between the condensation pressure and the evaporation pressure.
Figure 3:
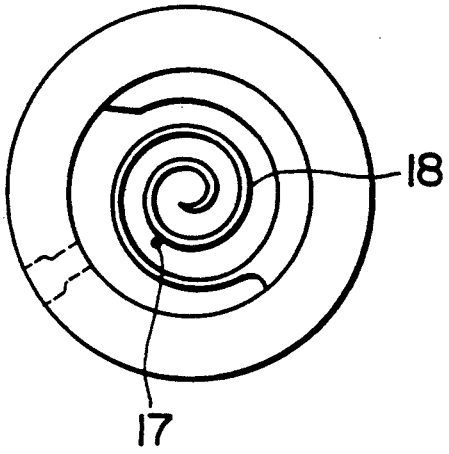
FIG. 3 is a plan view of a stationary spiral member in FIG. 1.

Referring now to the drawings wherein like reference numerals are used throughout the various views to designate like parts and, more particularly, to FIG. 1, according to this figure, a fixed displacement type compressor such as, for example, a scroll compressor is provided, with the scroll compressor having an operational evaporation temperature in a range of −45° to 5° C. The scroll compressor is arranged in a hermetically sealed vessel 8 and includes a compression chamber 14, a frame 11, an electric motor 13 and a crankshaft 12. A compressor section of the compressor includes an orbiting scroll member 10 having an end plate provided with a spiral wrap and a fixed scroll member with an end plate having a spiral wrap disposed thereon. The orbiting scroll member 10 and the fixed scroll member 9 are assembled so that the respective wraps are in engagement with each other and define a compression chamber 14 for compressing low pressure coolant and discharging the compressed coolant. The stationary scroll member 9 is provided with a communication hole 17 along the spiral wrap 18, with the communication hole being adapted to communicate with a connecting pipe.

Figure 4:
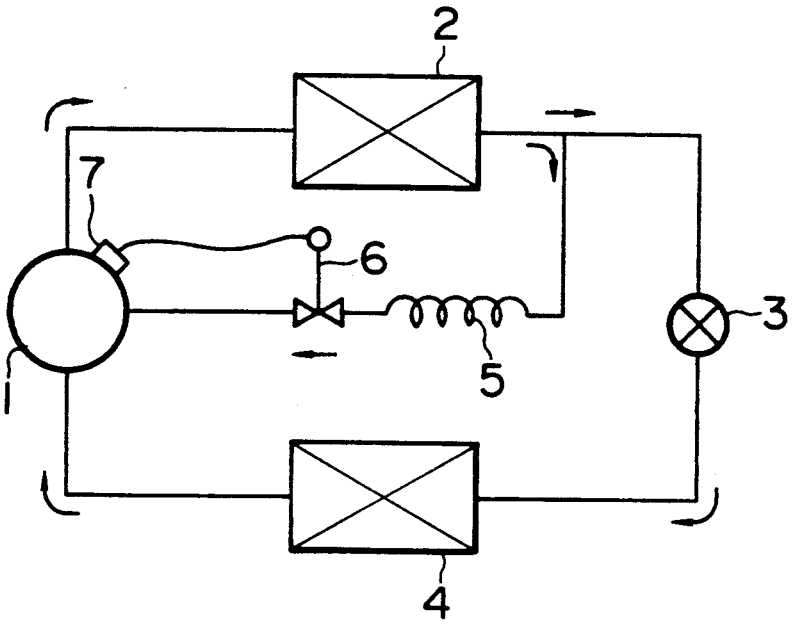
FIG. 4 is a diagram of a refrigeration cycle.
Figure 5:
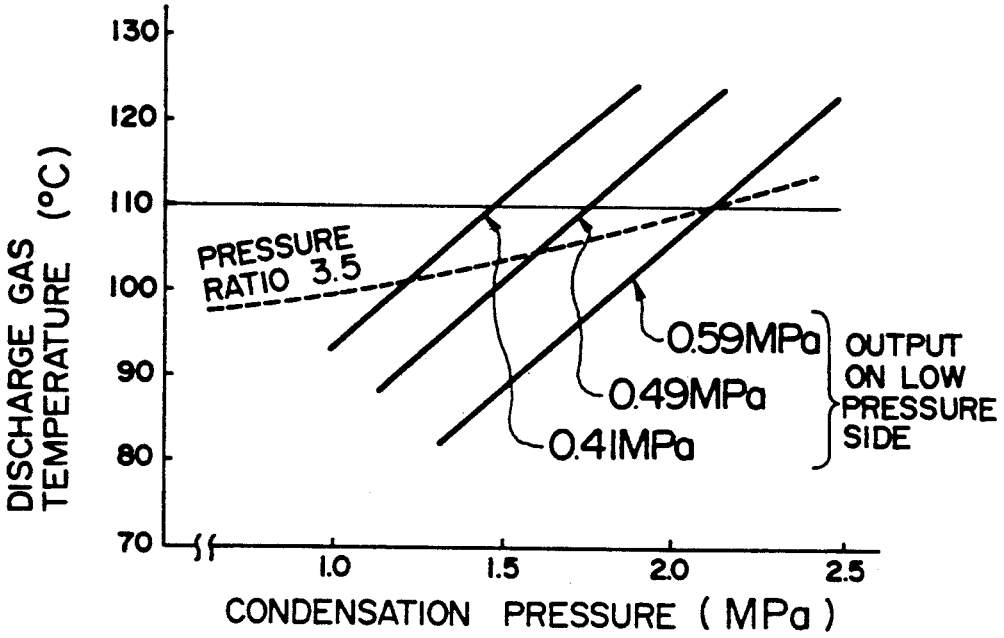
FIG. 5 is a graph showing a relationship between a discharge gas temperature and a condensation pressure.
Figure 6:
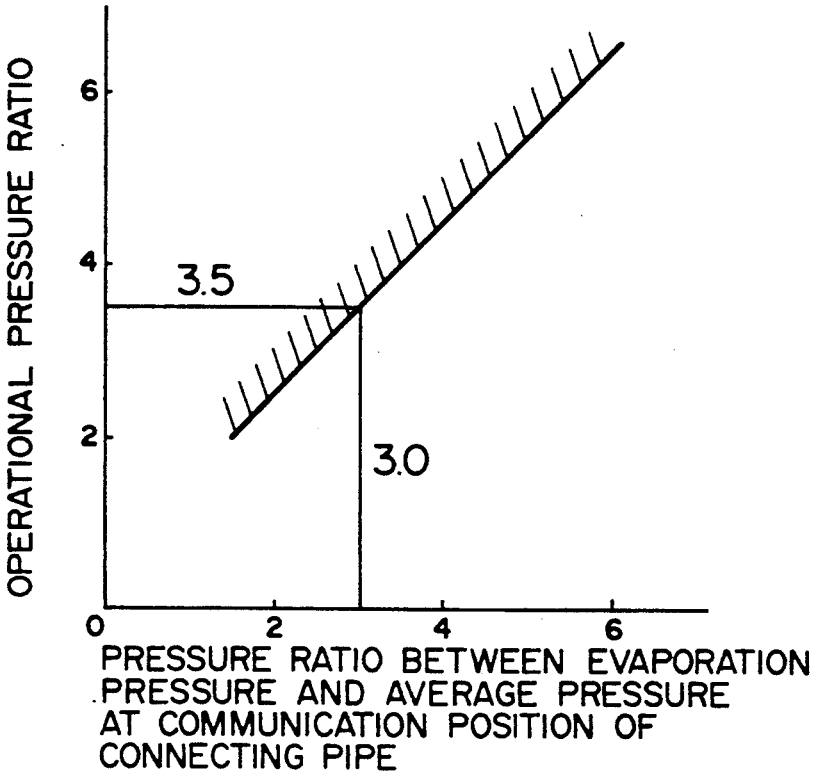
FIG. 6 is a graph showing a relationship between an operation pressure ratio and a pressure ratio of the average pressure.

FIG. 4 shows a refrigeration cycle in accordance with the embodiment. A high temperature and high pressure gas discharged from the compressor 1 is condensed in a condensor 2 into a high pressure liquefied coolant. Thereafter, the pressure of the coolant is decreased through an expansion valve 3 and is evaporated in an evaporator 4 to be suctioned into the compressor 1. On the other hand, a part of coolant is branched from an outlet of the condensor 2 and is introduced into the compression chamber held under the compression stroke within the compressor through the connecting pipe 5 and a solenoid valve 6. The opening/closing operation of the solenoid valve 6 is controlled by the action of a discharge gas thermostat 7 mounted on the compressor 1, so that the solenoid valve 6 is closed, when the discharge gas temperature is equal to or less than 100° C., for interrupting the introduction of the liquefied coolant. In FIG. 5 wherein an ordinate represents a temperature of the discharge gas and an abscissa represents a condensation pressure when the introduction of the liquefied coolant is interrupted, three cases of evaporation pressure are considered. In the compressor according to the invention, the motor is cooled down by the discharged gas, and it is necessary to maintain the temperature of the discharged gas at a level not higher than 110° C. The evaporation pressure of 0.59 MPa (on the lower pressure side) is at a maximum value within the evaporation pressure range, and at this time, the discharged gas temperature of 110° C. is reached with a minimum operational pressure ratio. At this time, the operational pressure ratio is 3.5, and, accordingly, it is necessary to communicate the connecting pipe with the compression chamber held in the compression stroke so that it is possible to cool the compressor at a level of the operationl pressure ratio not less than 3.5. Subsequently, the communication position of the connecting pipe is to be determined so that it is possible to introduce the liquefied coolant at the operational pressure ratio of 3.5. Referring to FIG. 6 wherein an abscissa represents a pressure ratio with respect to an average pressure at the position of the compression chamber which is held during the compression stroke and is in communication with the evaporation pressure through the connecting pipe and an ordinate represent the operational pressure ratio, the region where it is possible to introduce the liquefied coolant thereinto is determined. The pressure ratio at the position during the compression stroke communicating between the evaporation pressure and the connecting pipe is at 3.0 which value 0.5 less than the operational pressure ratio. It is also possible to introduce the liquefied coolant at a position where the pressure ratio is 0.5 less than the operational pressure ratio under another operational pressure condition. This means that it is necessary to provide the pressure differential of 0.5 for introducing the liquefied coolant.

Figure 7:
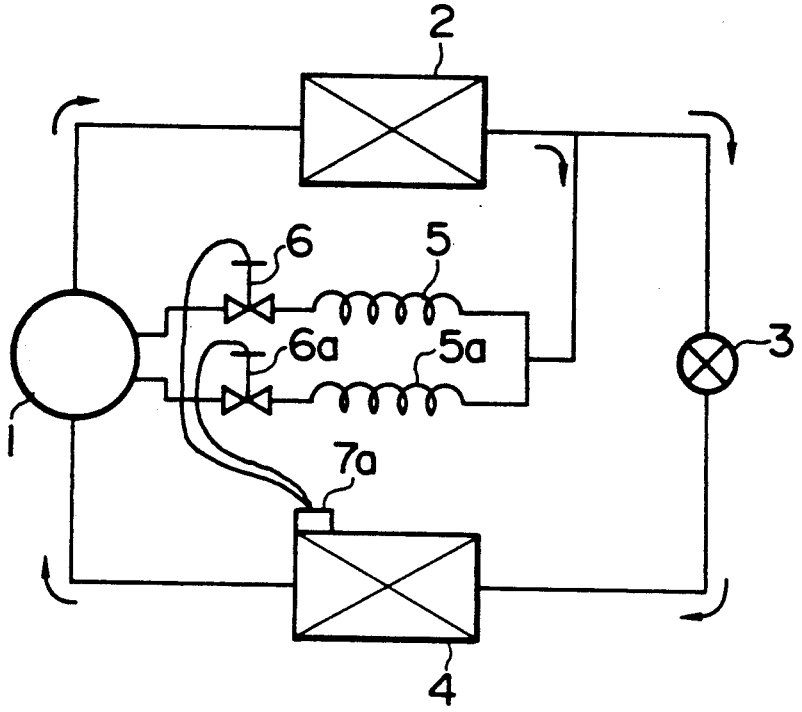
FIG. 7 is a diagram of a refrigeration cycle in accordance of a second embodiment of the invention.
Figure 8:
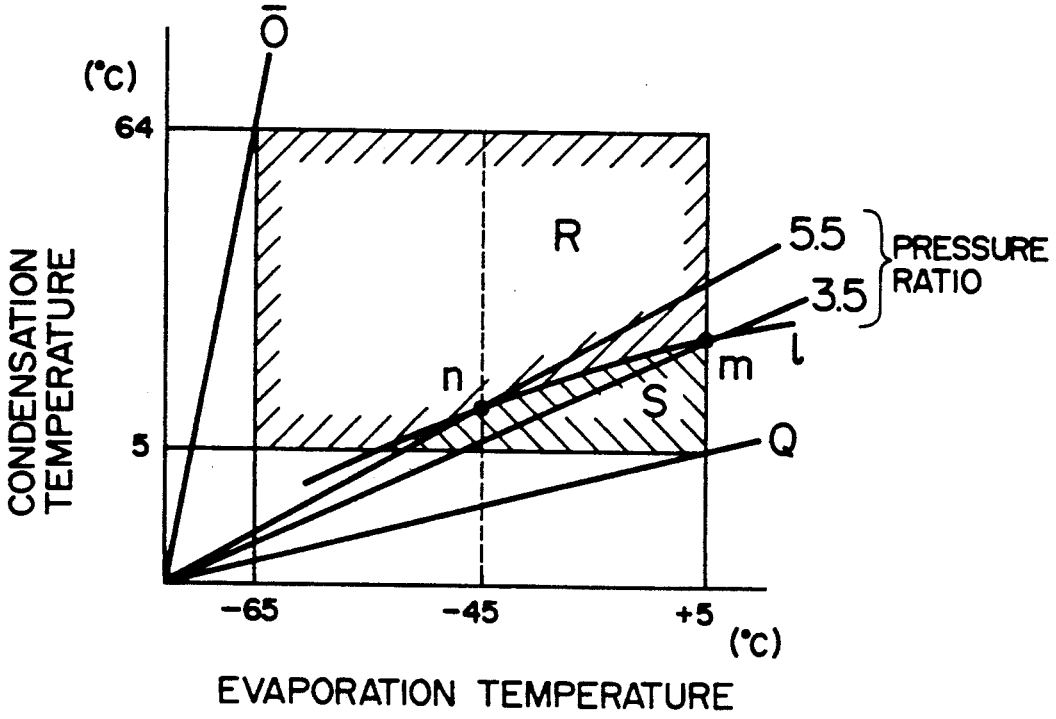
FIG. 8 is a graph showing a relationship between the condensation temperature and evaporation temperature in accordance with the second embodiment.

In a second embodiment of the invention shown in FIGS. 7 and 8, a second connecting pipe is used in addition to the first connecting pipe in order to ensure a broader evaporation temperature range of −65° to 5° C.

FIG. 7 shows a refrigeration cycle according to the second embodiment, in which a connecting pipe **5*a* and a solenoid valve 6*a* are added in contrast to the refrigeration cycle according to the first embodiment where only one communication pipe is used. In the second embodiment, by a thermostat 7*a* mounted within the evaporation vessel, the opening/closing operations of the connecting pipes 5 and 5*a*** are controlled so that the first connecting pipe is used at the evaporation temperature equal to or not less than −30° C. (at the low operation pressure ratio) which is a middle temperature in the selected evaporation temperature range, and the second connecting pipe is selected when the temperature is equal to or less than about −30° C.

The communication position of the first and second connecting pipes is shown in FIG. 8. With respect to the first connecting pipe, the same evaporation temperature range as that of the first embodiment is used on the high temperature side. Also, the communication possition for the first connecting pipe of the second embodiment is the same as that of the first embodiment. Namely, the communication position is such that the pressure ratio between the communication position pressure of the connecting pipe and the evaporation pressure is at 3.0 which value is 0.5 less than the operational pressure ratio 3.5, so that it is possible to introduce the liquefied coolant at the operation pressure ratio equal to or higher than 3.5.

The communication position of the second connecting pipe is determined so that it is possible to introduce the liquefied coolant at the evaporation temperature of −30° C. The operation pressure ratio at which the introduction of the liquefied coolant is necessary at the evaporation temperature of −30° C. is 5.5. The communication position is taken so that the pressure ratio between the communication position of the second connecting pipe and the evaporation pressure is 5.0.

When the communication position of the connecting pipes is thus determined and when the evaporation temperature after the start of the operation is rendered effective higher than −30° C., the first connecting pipe is for communication, thereby allowing the compressor to be cooled by the introduction of the liquefied coolant. When the object to be cooled is cooled so that the evaporation temperature reaches −30° C., the first connecting pipe is closed, and the cooling effect is performed only by the second connecting pipe. The flow rate of the liquefied coolant to be introduced is lower when the second connecting pipe is used when the first connecting pipe is used. Thus, the over cooling phenomenon or an increase of undesired compression effect may be suppressed.

In the second embodiment first and second connecting pipes are used; however it is apparent that the number of pipes may exceed two. Only one of the two communication chambers in the scroll compressor has been explained but it is possible to provide a plurality of communication pipes for the two compression chambers to introduce the liquefied coolant. Furthermore, it is possible to apply the invention to not only the scroll type compressor but also any other type compressor.

According to the invention, in an apparatus for preventing an overheating of the compressor by introducing a part of liquefied coolant held at a high temperature and liquefied in a condensor of the refrigeration cycle, into a compression chamber of the compressor during the compression stroke, it is possible to perform the necessary cooling of the compressor without fail. Thus, the compressor is not overheated due to the insufficiency of cooling and an over-compression due to the overcooling may be avoided to ensure high reliability. Also, the second connecting pipe is added and the first and second connecting pipes may be controlled whereby it is possible to perform a highly effective operation even within a wide operational range.

What is claimed is:

1. A method for preventing an overheating of a fixed displacement type compressor, the method comprising the steps of:

providing a connecting pipe having a first end in communication with an outlet of a condenser and a second end in communication with an interior of a compression chamber of the compressor at a position thereof wherein a pressure ratio of gas to an evaporation pressure is in a range of 3.0 to 3.5;

introducing a portion of high pressure liquified coolant liquified in the condenser of a refrigeration cycle;

detecting a temperature of discharged gas from the compressor by a thermostat;

controlling a flow rate of the introduced high pressure liquified coolant in dependence upon a detected temperature of the discharge gas by the thermostat by selectively interrupting a flow of the introduced high pressure liquified coolant so as to maintain the discharge gas at a predetermined temperature while preventing an overheating of the compressor over an operational range of the compressor; and introducing a flow of the high pressure liquid coolant through the connecting pipe when the evaporation temperature is reduced to below a predetermined evaporation temperature.

2. The method according to claim 1, wherein the step of providing the second connecting pipe includes communicating the second end of the second connecting pipe to the compression chamber at a higher pressure side than a position at which the second end of the first connecting pipe communicates with the compression chamber.

3. The method according to claim 1, wherein the step of controlling includes providing an electromagnetic valve in the connecting pipe, and operating said electromagnetic valve so as to selectively open and close the same in dependence upon the detected temperature by the thermostat.

4. An overheat preventing apparatus for a fixed displacement compressor comprising:

a condensor of a refrigeration cycle;

a connecting pipe for introducing a part of a high pressure coolant liquified in said condensor into a compression chamber for controlling a flow rate of the liquified coolant through said connecting pipe to thereby cool the compressor, said connecting pipe having a first end communicating with an outlet of the condensor and a second end communicating with the compression chamber at a position thereof wherein a pressure ratio of the gas to an evaporation pressure is in a range of 3.0 to 3.5;

means for controlling the flow of the high pressure liquefied coolant through said connecting pipe in dependence upon a detected temperature of an evaporator; and a second connecting pipe in fluid communication with a higher pressure side of the compressor than said first mentioned connecting pipe, wherein said connecting pipes are controlled in accordance with a temperature of the evaporator, and wherein said second connecting pipe is in fluid communication in a low evaporation temperature region within the operational pressure range, while said first-mentioned connecting pipe is in fluid communication in a high evaporation temperature region within the operational pressure range.

5. The overheat preventing apparatus of claim 4, wherein said means for controlling includes a first electromagnetic valve selectively operable to be opened and closed in dependence upon said detected temperature of an evaporator, and wherein a second electromagnetic valve is provided in the second connecting line and is operable to be opened and closed in dependence upon a temperature of the evaporator.

6. A method for preventing an overheating of a fixed displacement type compressor, the compressor including a compressor overheat preventing means including a connecting pipe for introducing a part of high pressure liquified coolant, liquified in a condenser of a refrigeration cycle, into a compression chamber maintained under a compression stroke of the compressor and for controlling a flow rate of the liquified coolant flowing through the connecting pipe to cool the compressor at a level of an operational pressure value not less than 3.5, the method comprising the steps of:

providing a electromagnetic valve within said connecting pipe;

communicating said connecting pipe with an interior of the compression chamber of the compressor at a position thereof wherein a pressure in the compression chamber is always less than a condensing pressure in an operational range of the refrigeration cycle;

detecting a temperature of discharged gas from the compressor by a thermostat mounted on the compressor; and controlling said electromagnetic valve according to the detected temperature so as to maintain the temperature of discharge gas lower than a predetermined temperature of 110° C.

7. The method according to claim 6, wherein the steps of controlling includes providing an electromagnetic valve in said connecting pipe, and operating said electromagnetic valve so as to selectively open and close the same in dependence upon the detected temperature by the thermostat.

8. The method according to claim 6, further comprising the steps of connecting a first end of said connecting pipe with an outlet of the compressor and a second end with an interior of the compression chamber of the compressor at a position thereof, and wherein a maximum value of an evaporation pressure is in a range of 3.0 to 3.5.

9. The method according to claim 6, further comprising the steps of:

providing a second connecting pipe having a electromagnetic valve within the second connecting pipe in addition to said first-mentioned connecting pipe; and communicating the second connecting pipe to the compression chamber at a higher pressure side than a position at which the first-mentioned connecting pipe communicates with the compression chamber.

10. The method according to the claim 9, further comprising the steps of communicating said second connecting pipe with a low evaporation temperature side of the compression chamber and said first connecting pipe with a high evaporation temperature side of the compression chamber.

11. An overheat preventing apparatus for a fixed displacement compressor including a connecting pipe for introducing a part of a high pressure coolant liquefied in a condenser of a refrigeration cycle into a compression chamber maintained under a compression stroke of the compressor, the compressor being cooled by controlling a flow rate of the high pressure coolant flowing through said connecting pipe, wherein said connecting pipe has an electromagnetic valve located within the connecting pipe, said electromagnetic valve is provided with means to control said electromagnetic valve in accordance with values detected by a thermostat mounted on the compressor so as to be opened to introduce liquified coolant into the compression chamber when a discharge gas temperature is higher than a predetermined temperature of 110° C., and said electromagnetic valve communicates the connecting pipe with a portion of the compressor, and wherein said means to control further provides that a mean pressure in the compression chamber maintained under the compression stroke is always less than a condensing pressure of the refrigeration cycle in an operational pressure condition in which said electromagnetic valve is controlled to open.

12. The overheat preventing apparatus of claim 11, wherein said electromagnetic valve selectively operable to be opened and closed in dependence upon the detected temperature of the discharged gas.

13. The overheat preventing apparatus according to claim 11, wherein said connecting pipe comprises a first connecting pipe and a second connecting pipe, said second connecting pipe in fluid communication with a higher pressure side of the compression chamber than that of said first connecting pipe, said first and second connecting pipes are controlled in accordance with one of a cooled box temperature, an evaporation temperature and evaporation pressure, said second connecting pipe being in fluid communication in a low evaporation temperature region within the operation pressure condition, while said first connecting pipe is in fluid communication in a high evaporation temperature region within the operation pressure condition.

* * * * *